US007047671B2

(12) United States Patent
Steed et al.

(10) Patent No.: US 7,047,671 B2
(45) Date of Patent: May 23, 2006

(54) DISPOSABLE SHOE INSERT

(76) Inventors: Cheryl Steed, 1980 N. Maud, #B, Chicago, IL (US) 60614; Maria Rodek, 110 Crimson Pl., Chester Springs, PA (US) 19425

( * ) Notice: Subject to any disclaimer, the term of this patent is extended or adjusted under 35 U.S.C. 154(b) by 0 days.

(21) Appl. No.: 09/922,239

(22) Filed: Aug. 3, 2001

(65) Prior Publication Data

US 2002/0066209 A1 Jun. 6, 2002

Related U.S. Application Data

(60) Provisional application No. 60/224,302, filed on Aug. 10, 2000.

(51) Int. Cl.
*A43B 13/38* (2006.01)

(52) U.S. Cl. ..... 36/44; 36/43

(58) Field of Classification Search ..... 36/43, 36/44

See application file for complete search history.

(56) References Cited

U.S. PATENT DOCUMENTS 4,055,699 A * 10/1977 Hsiung ..... 36/44
4,071,963 A 2/1978 Fukuoka
4,079,526 A 3/1978 Fukuoka
4,151,660 A 5/1979 Yoshimi et al.
4,192,086 A * 3/1980 Sichak ..... 36/44
4,316,333 A 2/1982 Rothschild
4,359,783 A * 11/1982 Andrews ..... 2/161.8
4,517,308 A 5/1985 Ehlenz et al.
4,603,698 A 8/1986 Guttmann Cherniak
4,643,683 A 2/1987 Orsini et al.
4,694,831 A 9/1987 Seltzer
4,776,109 A 10/1988 Sacre
4,808,458 A * 2/1989 Watt et al. ..... 428/90
4,841,648 A 6/1989 Shaffer et al.
4,864,740 A 9/1989 Oakley
5,022,168 A 6/1991 Jeppson, III et al.
5,197,208 A 3/1993 Lapidus
5,235,761 A 8/1993 Chang
5,388,349 A 2/1995 Ogden
5,400,526 A 3/1995 Sessa
5,619,809 A 4/1997 Sessa
5,675,914 A * 10/1997 Cintron ..... 36/3 B
5,727,336 A 3/1998 Ogden
5,799,414 A 9/1998 Kellerman (Continued)

*Primary Examiner*—M. D. Patterson
(74) *Attorney, Agent, or Firm*—Caesar, Rivise, Bernstein, Cohen & Pokotilow, Ltd.

(57) ABSTRACT

A disposable shoe insert having a soft, durable, resilient, absorbent and "high coefficient of friction" surface in contact with the human foot is provided. The material in contact with the foot comprises of a nonwoven material that has a static of dynamic coefficient of friction of 0.52 or above when tested against material from a pair of standard women's pantyhose containing 80% nylon and 20% spandex fibers. The other side of the insert consists of a slip-resistant synthetic coating that minimizes shoe insert slippage after being placed and positioned in the shoe. The insert provides a low cost and simple method of keeping the feet dry, comfortable, healthy and odor free. The frequent replacement of the insert promotes the reduction of bacterial build-up in the shoe over time, which in turn reduces shoe odor and helps prolong the life of the shoe itself. Optional features may include deodorizer, such as a time release fragrance, and/or odor neutralizer to help reduce or eliminate foot odor. Other additional product features may include the addition of antimicrobial agents and/or medicinal ingredients.

6 Claims, 3 Drawing Sheets

U.S. PATENT DOCUMENTS 5,896,677 A * 4/1999 Barsorian ..... 36/11.5
5,921,003 A 7/1999 Kim
5,930,916 A 8/1999 Connor
5,935,671 A 8/1999 Lhuillier
5,992,055 A 11/1999 Connor
6,112,432 A * 9/2000 Bray, Jr. et al. ..... 36/44

* cited by examiner

DISPOSABLE SHOE INSERT

This application claims the benefit of Provisional application Ser. No. 60/224,302, filed Aug. 10, 2000.

BACKGROUND OF THE INVENTION

The present invention relates to articles for insertion into the shoe. More particularly, the invention pertains to a disposable shoe insert that is economical and is used more frequently to enhance foot hygiene.

Over the years, there have been numerous types and sizes of shoe inserts introduced to the marketplace. These shoe inserts or insoles are relatively expensive and are intended for longer term use. Most consist of latex foam that are washable and contain odor neutralizers such as baking soda and/or activated charcoal. Unfortunately, the deodorant efficacy and effectiveness of the baking soda and/or activated charcoal are significantly diminished during the washing cycle. In addition, the presence of latex foam will promote foot irritation and discomfort to consumers who are more sensitive and allergic to natural latex. This phenomenon is even further worsened when the foot is enclosed within a warm, dark, moist and restricted air-circulation environment such as the shoe.

What is lacking and needed in the art is a disposable, economical and simple construction shoe insert that is intended for shorter use and provides an effective means of reducing odor, absorbing moisture and minimizing bacterial growth as a result. The encouragement to promote more frequent exchange of shoe inserts will enhance foot hygiene, especially for those who do not wear socks or stocking. The top surface of the insert has a "high coefficient of friction" nonwoven material, which provides good traction to the bottom of the foot during wear. The bottom of the insert has an anti-slip coating that allows the insert to adequately grip the inside of the shoe, without leaving adhesive residue or damaging the inner sole of the shoe. The combination of this "high coefficient of friction" top surface and anti-slip bottom surface will ensure that the insert will stay securely in place inside the shoe during use. The insert is also designed to have just one shape ("uni-foot ") to fit both the right and left foot, in order to be more convenient and easier to use. Therefore, proper traction (top & bottom) is even more important in this "uni-foot" insert design. In order to make the insert economical, it will not comprise of knit fabrics, aperatured films or other reusable/washable materials. It will comprise of no more than two laminated material layers, to minimize cost, in which at least one will be a "high coefficient of friction" nonwoven that directly contacts the foot.

SUMMARY OF THE INVENTION

In response to the discussed deficiencies in the prior art, a new disposable shoe insert has been developed. The disposable shoe insert of the present invention is economical, which comprises a soft/absorbent/durable/"high coefficient of friction" material on one side and a slip-resistant layer on the other side in contact with the shoe.

In one aspect, the present invention concerns a shoe insert that comprises a nonwoven material that is soft/absorbent/resilient and has a "high coefficient of friction." The nonwoven material is "suede-like" in both tactile feel and appearance. The back side of the nonwoven material is coated with cohesive, to provide slip-resistance. In order to provide deodorant efficacy, fragrance oil(s) and/or odor control liquid(s) may be sprayed or coated onto the nonwoven surface (opposite the cohesive coating). Antimicrobial, deodorizer and/or medicinal ingredient(s) may also be applied to the nonwoven surface, if so desired. The deodorizer and antimicrobial ingredients in this execution are preferably in the liquid state and come in one single blend for simplicity in processing and drying. However, more than one liquid application may be executed if necessary.

In another aspect, the present invention concerns a shoe insert that comprises a nonwoven material that is soft/absorbent/durable/resilient and has a "high coefficient of friction" on the top side and a thin synthetic foam or poly film layer on the bottom side. The nonwoven material is laminated to the thin foam or poly film layer preferably with adhesive. The adhesive can be a hot melt adhesive or cold glue emulsion. The two materials may also be bonded together by heat sealing, ultrasonic or stitching. A fine layer of cohesive is coated onto the foam or poly film side, which is opposite to the side laminated to the nonwoven. The cohesive is not a typical pressure sensitive adhesive. It does not adhere to anything but itself. Its purpose is not to adhere to the inside of the shoe, but rather provide a slip-resistant surface.

In order to provide deodorant efficacy, fragrance oil(s) and/or odor control liquid(s) may be sprayed on top of the nonwoven surface. Time release fragrance powder(s) and/or odor control powder(s) may also be applied between the nonwoven material and foam or poly layers. This includes baking soda (sodium bicarbonate), synthetic zeolites, granulated charcoal, etc. Antimicrobial agent(s) and/or medicinal ingredient(s) may also be applied to the nonwoven surface, if so desired. The deodorizer, antimicrobal and medicinal ingredient(s) may be sprayed or coated on top of the nonwoven surface, are preferably in the liquid state and come in one single blend for simplicity in processing and drying. The deodorizer, antimicrobial and medicinal ingredients that are applied between the nonwoven and foam or poly film layers are preferably in the solid (particulate) state. This allows the flexibility in selecting ingredients to be either solid (particulate) or liquid or any combination of the two.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION OF THE PREFERRED EMBODIMENTS

Figure 1:
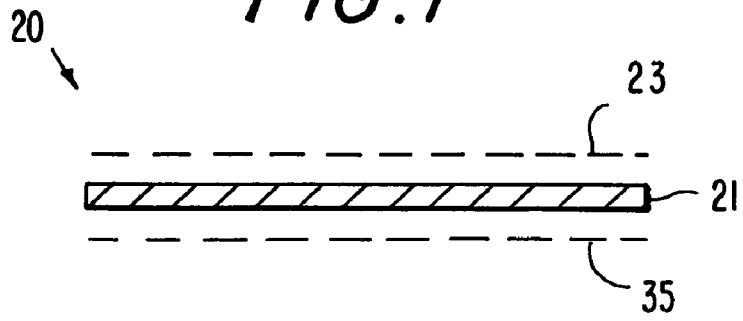
FIG. 1 is a traverse section (cross-sectional) view of a single-layer insert design with cohesive coating on the back side.
Figure 2:
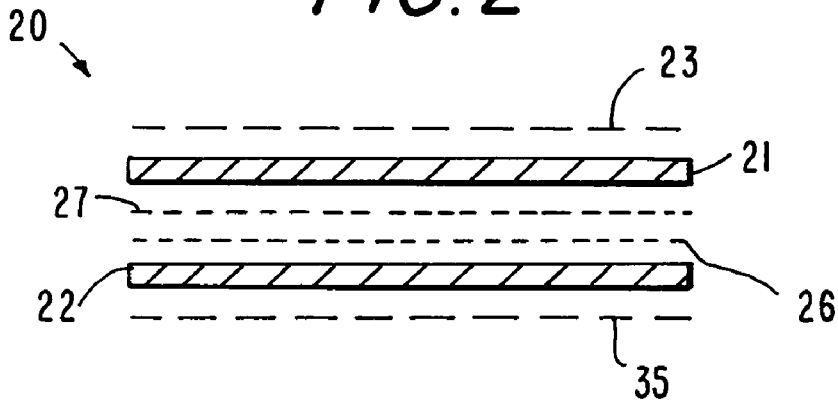
FIG. 2 is a traverse section (cross-sectional) view of a dual-layer insert design, comprised of a nonwoven on one side, foam or poly film with low-tack adhesive or cohesive coating on the back side.
Figure 3:
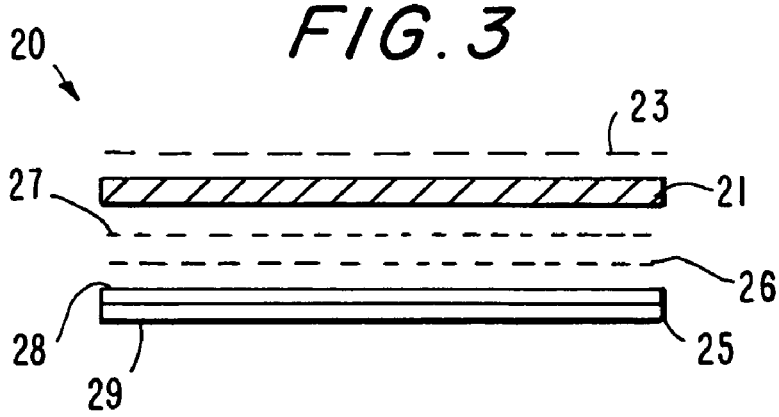
FIG. 3 is a traverse section (cross-sectional) view of a dual-layer insert design, comprising of a nonwoven on one side, co-extruded poly film with Ethylene Vinyl Acetate (EVA) or nonwoven on one side, poly film with low-tack adhesive on the back side.

One embodiment of the shoe insert 20 is illustrated in FIG. 1. Through-out the drawings, the components illustrated in section views such as FIGS. 1, 2 & 3 are shown separated from one another, although it should be understood that the components actually contact one another. The shoe insert 20 is designed to have a non-slip bottom layer, which is in direct contact with the inside sole of the shoe.

The shoe insert 20 in FIG. 1 consists of a top material layer 21 having inside and outside portions and a non-slip coating 35 disposed along the outside portion. The top material layer 21 is preferably a nonwoven material, which is economical, soft, durable, slightly resilient and has a "high coefficient of friction." Layer 21 has a coefficient of friction along the inside portion of 0.52 or greater, and preferably between 0.52 and 0.82.

One suitable material for the top layer 21 is a suede-like nonwoven composite identified as L0500 and available from Vivelle GmbH in Hambrucken, Germany. The surface fibers in L0500 are Polyethylene and the preferred substrates are viscose or polyester based. The Polyethylene fibers in L0500 are orientated in the vertical direction, which provides a "high coefficient of friction" surface (both static & dynamic), preferably 0.52 or above.

Another suitable material for the top layer 21 includes a hyrdroentangled nonwoven composite identified as Miratec and available from Polymer Group, Inc. (PGI) of Lexington, N.C. The fibers in Miratec are polyester and rayon; however, they may be of cotton and nylon as well. Note that rayon and cotton fibers absorbe fluids, such as sweat from feet.

Other suitable nonwoven materials for the top layer 21 include chemically bonded polyester and rayon (CHEM-BOND), spunbond polypropylene (SBPP), spunbond-melt-down-spunbond (SMS), through-air bi-component fibers (TABICO), thermal-bond polypropylene (TBPP), adhesive-bond polyester (ABPET), spunbond polyethylene (SBPE) and spunlace. Still other suitable materials for the top layer 21 include aperatured films, airlaid composites, knit fabarics, coform composites, paper towels, wet-strength tissues, and unmoistened baby wipe materials.

Note that it is preferred that the top material layer 21 is also treated with a surfactant and Aloe Vera for added softness. Aloe Vera is a plant from the Aloe plant family. Its extract is used for its medicinal properties in a variety of health care and cosmetic products. It contains six antiseptic agents (Lupeol, salicylic acid, urea nirtogen, cinnamonic acid, phenols and sulphur), 3 anti-flammatory fatty acids (cholestrol, camperstreol and B-sitosterol) and 23 polypeptids (immune stimulators).

One suitable surfactant is Silastol PST, a hydrophilic non-ionic surfactant, which is available from Schill & Seilacher GmbH & Co. of Boblingen, Germany. Another hydrophilizing anionic surfactant that is similar to Silastrol PST in functional performance is Triton X-200, manufactured by Rohm & Haas of Philadelphia, Pa. Triton X-200 comprises sodium alkylaryl polyether sulfonate that is applied to polymeric fibers (such as polyethylene, polypropylene, polyester, etc.) in order to make it "wettable". Polymeric fibers without surfactant treatment are fluid repellent and act like a "raincoat." Surfactants are surface-active agents that help increase the surface tension of the hydrophilic fibers within a nonwoven web.

The non-slip coating 35 shown in FIG. 1 is preferably a cohesive, which will provide a high anti-shear surface for the bottom of the shoe insert 20. One suitable material for the non-slip coating 35 is a cohesive identified as #C-7117 and available from ATO Findley in Wauwatosa, Wis. Other suitable materials for the non-slip coating 35 include low-tack pressure sensitive adhesives, synthetic rubber and latex coatings.

In FIGS. 4A–4I, two basic types of adhesive application systems are used: 1) Extrusion Type (slot-coat and comb slot-coat), 2) Spray Type (Meltblown and Spiral). Cohesives are usually applied in the cold state, thus they are not considered hot melt adhesives. However, there are hot melt adhesives similar in performance and properties to that of cohesives. Therefore, the various adhesive application systems that are mentioned can apply to either cold or hot melt adhesives.

Figures 4A, 4B, 4C, 4D:
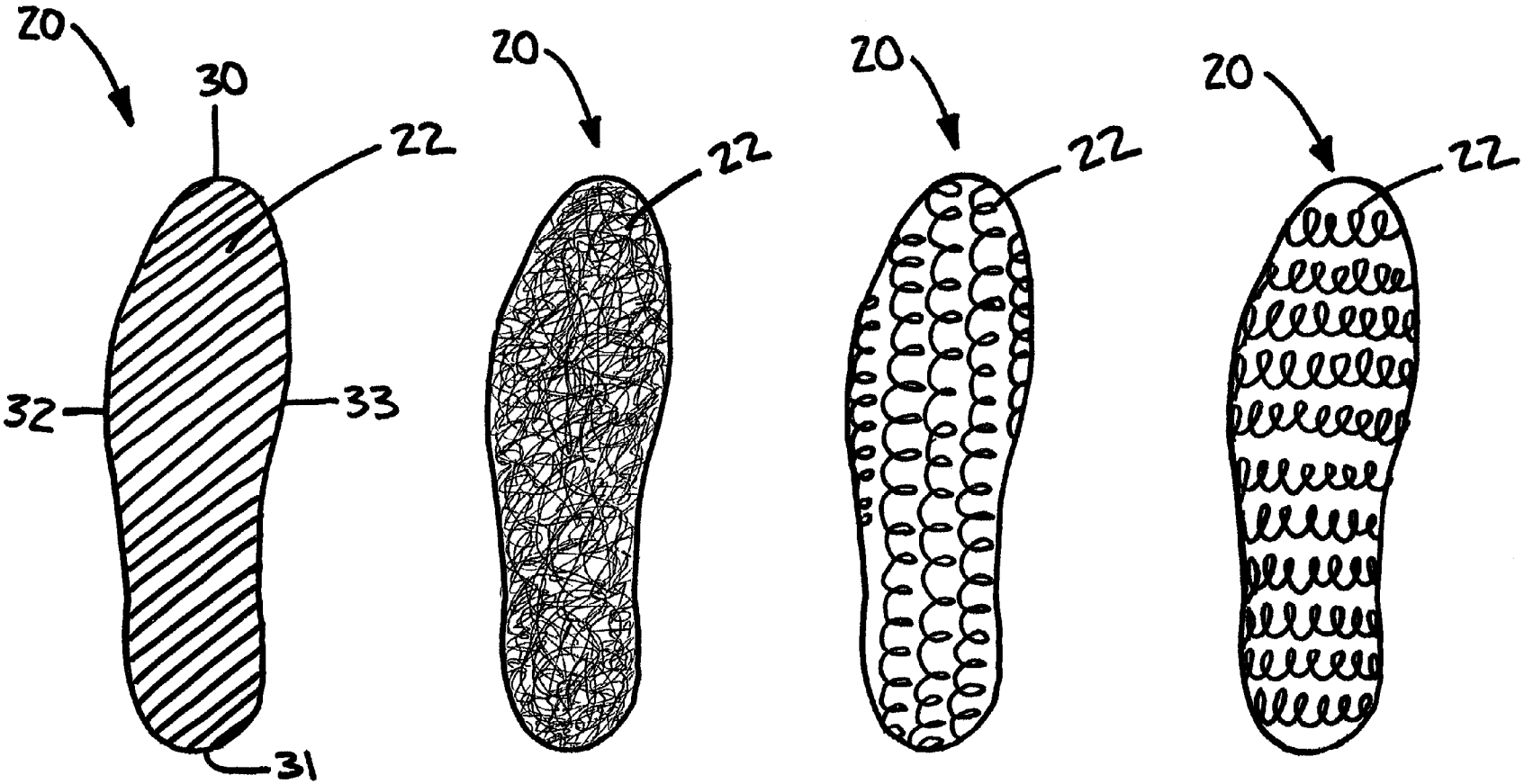
FIG. 4A is a bottom view of a full "slot coat" cohesive pattern.
FIG. 4B is a bottom view of a "melt-blown spray" cohesive pattern.
FIG. 4C is a bottom view of a vertical "spiral spray" cohesive pattern.
FIG. 4D is a bottom view of a horizontal "spiral spray" cohesive pattern.

The non-slip coating 35 may be applied to the top material layer 21 along the outside portion thereof in a number of ways. See FIGS. 4A–4I. Note that FIG. 4A is a full "slot coated" version (a "slot-coat" adhesive application), where the adhesive covers the entire bottom of the shoe insert 20 and is applied in a thick film layer with a cohesive add-on range of 5 to 300 milligrams per square inch. FIGS. 4B–4D applies the cohesive to the bottom of the top material layer 21 in various hot melt spray patterns such as meltblown, vertical spiral and horizontal spiral. FIG. 4B uses a "meltblown" adhesive application system with a cohesive add-on range of 1 to 100 milligrams per square inch.

Figure 4E:
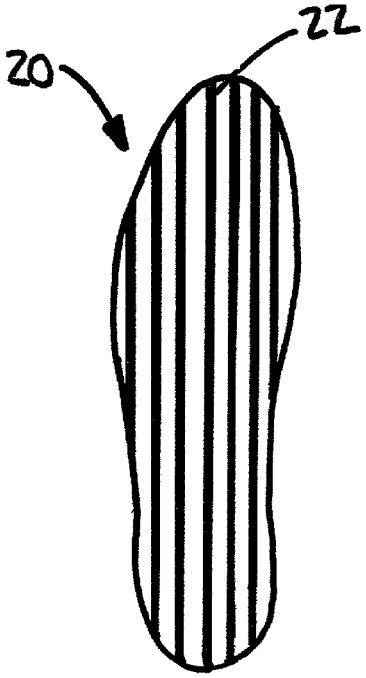
FIG. 4E is a bottom view of a vertical tracks "slot coat" cohesive pattern.
Figure 4F:
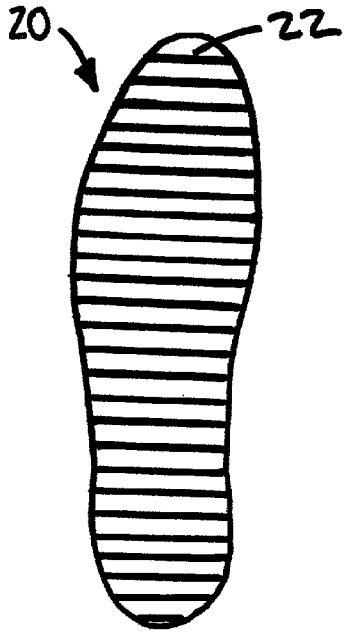
FIG. 4F is a bottom view of a horizontal tracks "slot coat" cohesive pattern.
Figure 4G:
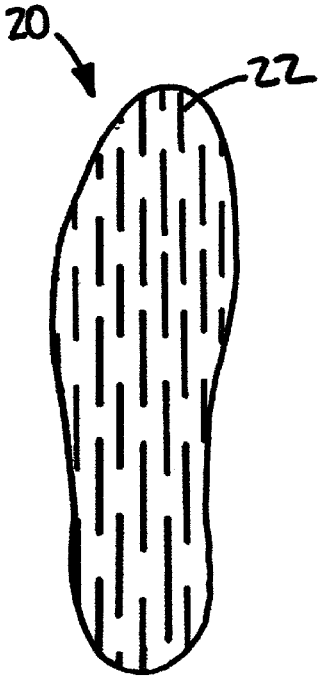
FIG. 4G is a bottom view of vertical intermittent tracks "slot coat" cohesive pattern.
Figure 4H:
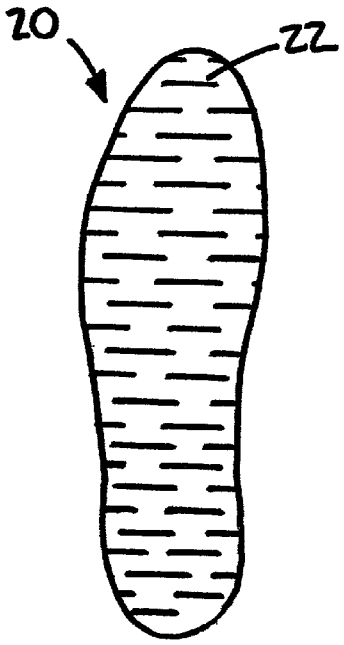
FIG. 4H is a bottom view of horizontal intermittent tracks "slot coat" cohesive pattern.

FIGS. 4C–4D use a "spiral adhesive application system with a cohesive add-on range of 1 to 100 milligrams per square inch. FIGS. 4E–4F applies the cohesive to the bottom of the top material layer 21 in two bead patterns, vertical and horizontal. FIGS. 4E–4F use a "comb slot-coat" adhesive application system with a cohesive add-on range of 5 to 250 milligrams per square inch. FIGS. 4G–4H applies the cohesive to the bottom of the top material layer 21 in two intermittent track patterns, vertical and horizontal. FIGS. 4G–4H also use a "comb slot-coat" adhesive application system as in FIGS. 4E–4F, however in intermittent patterns (not continuous); the cohesive add-on range is 5 to 300 milligrams per square inch.

Note that all of these patterns FIGS. 4A–4H could be registered to a specific length or width and phase onto the shoe insert 20 as desired. The cohesive patterns do not have to be continuous.

Figure 4I:
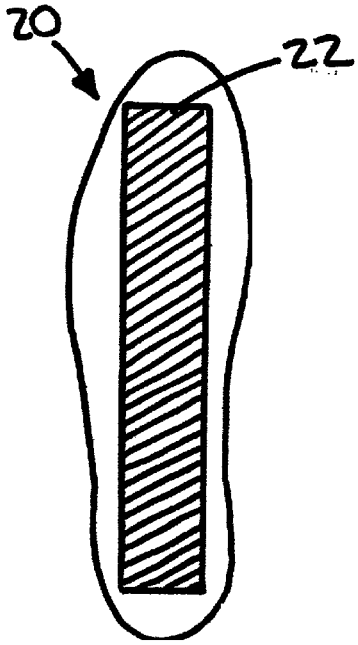
FIG. 4I is a bottom view of a single track "slot coat" cohesive pattern.

The last figure, FIG. 4I, applies the cohesive to the bottom of the top material layer 21 in a registered, non-continuous, single adhesive pattern. The adhesive pattern is "registered" to be inside the perimeter and centered within the Shoe Insert, depending on its size. Since there will be several Shoe Insert sizes, the adhesive pattern needs to be proportionally fitted and registered for each size range.

FIG. 4I also uses "slot coat" adhesive application system as in FIG. 4A; however, it is an intermittent and narrower pattern. The cohesive add-on range is 5 to 300 milligrams per square inch. The cohesive is applied such that it is spaced a certain distance from the front edge 30/back edge 31 and left side 32/right side edge 33 of the shoe insert 20, in order to make it easier s for the finger to pinch the edges of the product and pull it out during removal.

The shoe insert 20 of FIG. 1 may include a surface treatment 23 for antimicrobial, deodorizing or medicinal purposes on the top material layer 21.

One suitable surface treatment 23 would be a deodorizer, such as a fragrance oil #1702-2001 from Rely Fragrances and Ingredients, Inc. in Middletown, N.Y. Another suitable surface treatment 23 would be an odor neutralizer identified as ODACON available from Whiteley Industries Pty. Ltd. in Mascot, Australia. Another suitable surface treatment 23 would be an antimicrobial agent identified as AEGIS Microbe Shield available from Dow Corning in Midland, Mich. Another suitable surface treatment 23 would be antibacterial/medicial liquid, identified as Tea Tree blend available from G. R. Davis Pty. Ltd. in Hornsby, Australia. Yet another suitable surface treatment 23 would be antimicrobial/odor reduction liquid identified as QuatrODOR or QuartoGuard available from Comfort Touch in Miami, Fla. Note that all of the materials identified as surface treatment 23 may be combined with one another for maximum effect and performance.

Surface treatments/solutions are usually applied two ways: "contact coated" or "sprayed." Contact coating involves the material to be either "dunked" into a solution or a gravure roll to "wipe" the solution onto the material. Spraying involves the solution to be dispensed upon the material without actual contact. Spraying is more preferred in our embodiment. Treatment/solution add-on will range from 0.1 to 2.0 grams per Shoe Insert.

Another embodiment of the shoe insert 20 is illustrated in FIG. 2. The shoe insert 20 consists of a top material layer 21, a bottom material layer 22 and a non-slip coating 35. The top material layer 21 will be similar to the types of preferred materials previously described in FIG. 1. The bottom material layer 22 will preferably comprise of polyethylene (PE) film identified as Code #1PE available from Clopay Plastic Products in Cincinnati, Ohio. Another suitable material for the bottom material layer 22 is polyethylene (PE) foam identified as Cell-Aire CA-30 available from Sealed Air Corporation in Saddle Brook, N.J. Other suitable materials for the bottom material layer 22 are polypropylene (PP) film, polyester (PET) film, co-extruded film, laminated foam, laminated foam/film, expanded polystyrene (EPS), Polyurethane (PU), expanded polypropylene (EPP), vinyl, reinforced paper, coated paper, cardboard, etc.

It is usually better to apply cohesives to poly films substrates, since there are no fiber pores in which the cohesive can migrate or penetrate through, which otherwise can cause "sticky build-up" processing problems on the machine and needlessly waste cohesive material over time. The addition of film layer to the fabric material also increases the "stiffness" or "structural stability" of the Shoe Insert, which makes it easier to insert into the shoe. Otherwise, the nonwoven material by itself may be "flimsy" and thus be difficult to insert "deep" into the shoe.

Another embodiment of the shoe insert 20 is illustrated in FIG. 3. The shoe insert 20 consists of a top material layer 21 and a non-slip material layer 25. The top material layer 21 would be similar to the types of preferred materials previously described in FIG. 1. The non-slip material layer 25 will be different versus FIG. 2 and will preferably be made from a co-extruded polyethylene (PE)/ethylene-vinyl-acetate (EVA) film identified as #3453A available from Huntsman Packaging in Salt Lake City, Utah. The non-slip material 25 has a polyethylene (PE) layer 28 and ethylene-vinyl-acetate (EVA) layer 29. The ethylene-vinyl-acetate (EVA) layer 29 has a coefficient of friction higher than that of top layer 21 and will be in direct contact with the insole of the shoe. Another suitable material for the non-slip material layer 25 is polyethylene tape (clear) identified as #2104 available form 3M Corporation in St. Paul, Minn. Another suitable material for the non-slip material layer 25 is transparent polyester tape identified as #336 available from 3M Corporation in St. Paul, Minn. The non-slip material 25 has either a polyethylene (PE) film layer 28 or a polyester (PET) film layer 28 and a low-tack adhesive layer 29. The low-tack adhesive layer 29 has a coefficient of friction higher than that of top layer 21 and will be in direct contact with the insole of the shoe. Other suitable materials for the non-slip material layer 24 are polyurethane films, synthetic rubber films, polyethylene films containing metallacine, latex and spandex materials.

The top material layer 21 and non-slip material layer 25 or bottom material layer 22 of the shoe insert 20 per FIG. 2 and FIG. 3 would be bonded together by means of a pressure sensitive adhesive 26 such as hot melt construction adhesive #70-4535 available from National Starch and Chemical Company in Bridgewater, N.J. Other means of adhering the materials together would include cold glue emulsion lamination, ultrasonic bonding, heat sealing, hydroentanglement and stiching.

The shoe insert 20 per FIG. 2 and FIG. 3 may also include internal ingredient(s) 27 that are sandwiched between the top material layer 21 and either the non-slip material layer 25 or bottom material layer 22. One suitable internal ingredient 27 would be an odor neutralizing particulate identified as sodium bicarbonate (Grade 5) available from Arm & Hammer in Princeton, N.J. Another suitable ingredient 27 would be a time release/odor masking fragrance identified as micro-encapsulated fragrance and starch available from Rely Fragrances and Ingredients, Inc. in Middletown, N.Y. Yet another suitable internal ingredient 27 would be a synthetic zeolite powder identified as ABSCENTS Series 3000 available from UOP in Des Plaines, Ill. Note that all of the material identified as internal ingredients may be combined with one another for maximum effect and performance.

In terms of adding other types of internal ingredients (such as sodium bicarbonate, synthetic zeolites, micro-encapsulated powders, etc.), this is done by dispensing it in between the top fabric and bottom film layers and then laminating it all together with a hot melt adhesive. The internal ingredient would be in particulate form and be randomly scattered within the material layers. The fact that the internal ingredient is dispensed and then laminated between the material layers is referred to as being "sandwiched."

The shoe insert 20 per FIG. 2 and FIG. 3 may also include a surface treatment 23 on the top material layer 21, as previously described in FIG. 1. These include fragrance oils and antimicrobial liquids such as ODACON, QuatrODOR and Tea Tree oil blends. One preferred combination would be to use ODACON antimicrobial as a surface treatment 23 on the top material layer 21 and micro-encapsulated fragrance powder as an internal ingredient 27. Another preferred combination would be to use QuatrGuard or QuatrODOR antimicrobial/deodorizer as a surface treatment 23 on the top material layer 21 and sodium bicarbonate as an internal ingredient 27. However, any combinations and numbers of surface treatments 23 and internal ingredients 27 may be used to maximize performance for the shoe insert 20.

In order to differentiate the type of nonwoven to be used as the top layer material 21, testing was conducted to determine the preferred "coefficient of friction" against the material of a standard women's pantyhose. CITECH (Center for Information on Technology for Health Care) executed the testing on seven different types of nonwoven materials that are commercially available in the industry. CITECH is an independent testing organization that serves the medical device industry. CITECH provides testing of safety and performance based on extensive knowledge of a broad range of medical devices. CITECH is accredited by FDA as a third-party reviewer of eligible 510 (k) submissions. It is also endorsed by ECRI, the world's largest independent evaluator of healthcare technology, and by hospitals and other agencies worldwide.

"Coefficient of friction" material testing was done on an Instron Model 1125 universal testing machine a Model 2511-302 load cell. The test apparatus was calibrated prior to testing by hanging precision weights from the load cell. The contact area of the nylon surface (standard women's pantyhose) used for the measurements was 8.5×8.5 cm (72 square cm). The nylon was cut from the foot section of a pair of Hanes® pantyhose, identified as True Reflections™ light control top sandalfoot, #E50 (off-black, size CD). The package stated the pantyhose material to be 80% nylon and 20% Spandex.

The "coefficient of friction" between two surfaces is a dimensionless index that describes the ease of pulling one surface against the other. If the motion is horizontal, then the "coefficient of friction" is:

$\mu = F/R$ where $\mu$ is the "coefficient of friction"

F is the force needed to pull the top surface along the bottom

R is the weight of the top surface

This equation shows that $\mu$ is independent of the weight and of the speed (although these may not hold at extreme values of either). The lower the value of $\mu$, the easier it is to pull the top surface along the bottom one. In most cases, it takes a greater force to start the top surface moving along the bottom one than it does to keep it moving, once it has begun moving. Therefore, there are two "coefficients of friction": the static coefficient and the dynamic coefficient. Both of these were measured and recorded.

To measure the "coefficient of friction," it is necessary to know the weight of the top surface and to pull it steadily, while recording the force. Thus, a "sled" with a flat, square bottom (approximately 8.5 cm on a side) was constructed. A piece of nylon material (from a standard women's pantyhose) was stretched over the "sled" and taped down. Then the "sled" was weighed to a total of 2,120 grams. Each piece of nonwoven test sample was taped onto a flat plate, adjacent the Instron universal testing machine. One end of a string was attached to the side of the "sled," that ran around a low-friction pulley mounted on the Instron (which pulls in the vertical direction), while the other end of the string was attached to the crosshead of the Instron. The crosshead of the Instron was set up to move slowly upward, so that the "sled" was pulled horizontally over the nonwoven test sample and the force was recorded on a chart recorder. The static "coefficient of friction" was determined by the peak force, as the "sled" begins moving, while the dynamic "coefficient of friction" was determined by the steady force after it begins to move.

The nonwoven test samples that were analyzed were coded as follows:

| Code | Material Description |
|---|---|
| A | Spun Bonded Polypropylene (100% PP), 15 grams/square meter |
| B | Thermal Bonded Polypropylene (100% PP), 30 grams/square meter |
| C | TABICO (Through-Air Bonded Bi-Component fibers @ 50% PE, 50% PP), 40 grams/square meter |
| D | ABPET (Adhesive Bonded Polyester @ 100% PET), 40 grams/square meter |
| E | Chembond T-1285.1-1210 (Chemically Bonded @ 60% PET, 40% rayon) |
| F | Suede-like Fabric (Polyethylene fibers on viscose substrate) |
| G | Tricot KK-073 (50% rayon, 50% polyester), 135 grams/square meter |

The test results are listed in Table 1: Crosshead speed is 200 mm/min except for bold, which is 100 mm/min. Method "S" denotes second set run on opposite side. Method "P" denotes second set run perpendicular to first set on same side. Applied mass is 2,120 g.

The test results confirmed that Code F (Suede-like Fabric) provided significantly higher static and dynamic "coefficient of friction" values versus all the other nonwoven samples. Code F provided "coefficient of friction" values in the range of 0.62 to 0.73, while all the other commercial nonwoven materials ranged from 0.28 to 0.51. None of the other nonwoven material samples was above 0.52

TABLE 1

| | | Coefficient of Friction | | | | | | |
|---|---|---|---|---|---|---|---|---|
| Material | | Run #1 | Run #2 | Average | Run #1 | Run #2 | Average | Second Set Method |
| A | Static | 0.31 | 0.32 | 0.32 | 0.31 | 0.31 | 0.31 | P |
| | Dynamic | 0.29 | 0.28 | 0.28 | 0.29 | 0.28 | 0.29 | |
| B | Static | 0.42 | 0.40 | 0.41 | 0.32 | 0.33 | 0.33 | S |
| | Dynamic | 0.38 | 0.36 | 0.37 | 0.30 | 0.29 | 0.29 | |
| C | Static | 0.37 | 0.38 | 0.37 | 0.41 | 0.40 | 0.40 | S |
| | Dynamic | 0.32 | 0.33 | 0.32 | 0.36 | 0.35 | 0.36 | |
| D | Static | 0.44 | 0.44 | 0.44 | 0.46 | 0.47 | 0.46 | 5 |
| | Dynamic | 0.37 | 0.37 | 0.37 | 0.40 | 0.41 | 0.40 | |

TABLE 1-continued

| | Material | Coefficient of Friction Run #1 | Run #2 | Average | Run #1 | Run #2 | Average | Second Set Method |
|---|---|---|---|---|---|---|---|---|
| E | Static | **0.46** | **0.48** | **0.47** | **0.51** | **0.48** | **0.49** | P |
| | Dynamic | **0.46** | **0.48** | **0.47** | **0.51** | **0.48** | **0.49** | |
| F | Static | 0.69 | 0.65 | 0.67 | **0.73** | **0.66** | **0.69** | P |
| | Dynamic | 0.67 | 0.62 | 0.65 | **0.65** | **0.64** | **0.64** | |
| G | Static | **0.50** | **0.48** | **0.49** | **0.51** | **0.50** | **0.51** | P |
| | Dynamic | **0.43** | **0.42** | **0.42** | **0.43** | **0.43** | **0.43** | |

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Therefore, the invention should not be limited by the specific embodiments described, but only by the claims.

The invention claimed is:

1. A shoe insert comprising:

a non-woven composite layer comprising polyethylene and viscose fibers, said polyethylene fibers being soft fibers that are oriented in a vertical direction, said composite layer having an inside surface portion and an outside surface portion, said inside surface portion of said composite layer providing a coefficient of friction of at least 0.62; and a non-slip material layer comprising polyester tape secured to said outside surface portion of said composite layer, said polyester tape having an first surface and a second surface, said second surface of said polyester tape comprising a very low tack adhesive, said first surface of said polyester tape being disposed confronting said outside surface portion of said composite layer, said second surface of said polyester tape having a coefficient of friction that is greater than the coefficient of friction of said inside surface portion of said composite layer.

2. The shoe insert of claim 1, wherein said non-woven composite layer additionally comprises a foam layer.

3. The shoe insert of claim 1, wherein said composite layer is treated with a surfactant.

4. The shoe insert of claim 1, wherein said inside surface portion of said composite layer has a surface treatment selected from the group consisting of a deodorizer and an anti-bacterial agent.

5. The shoe insert of claim 1, further comprising an internal ingredient sandwiched between said composite layer and said non-slip material layer.

6. The shoe insert of claim 5, wherein said internal ingredient is selected from the group consisting of an odor-neutralizing particulate and a masking fragrance.

* * * * *